US006196900B1

(12) United States Patent
Zhang et al.

(10) Patent No.: US 6,196,900 B1
(45) Date of Patent: Mar. 6, 2001

(54) ULTRASONIC TRANSDUCER SLURRY DISPENSER

(75) Inventors: Liming Zhang, Sunnyvale; Samuel Vance Dunton; Milind Ganesh Weling, both of San Jose, all of CA (US)

(73) Assignee: VLSI Technology, Inc., San Jose, CA (US)

( * ) Notice: Subject to any disclaimer, the term of this patent is extended or adjusted under 35 U.S.C. 154(b) by 0 days.

(21) Appl. No.: 09/390,455

(22) Filed: Sep. 7, 1999

(51) Int. Cl.[7] ..... B24B 1/00

(52) U.S. Cl. ..... 451/60; 451/36; 451/41; 451/287; 451/288; 451/446

(58) Field of Search ..... 451/36, 60, 41, 451/287, 288, 446

(56) References Cited

U.S. PATENT DOCUMENTS 5,522,965 * 6/1996 Chisholm et al. ..... 156/636.1
5,683,289 * 11/1997 Hempel, Jr. ..... 451/56
5,738,573 * 4/1998 Yeuh ..... 451/287
5,895,550 * 4/1999 Andreas ..... 156/345
6,062,954 * 5/2000 Izumi ..... 451/72

* cited by examiner

*Primary Examiner*—David A. Scherbel
*Assistant Examiner*—Shantese McDonald
(74) *Attorney, Agent, or Firm*—Wagner, Murabito & Hao LLP

(57) ABSTRACT

The present invention is an ultrasonic transducer slurry dispensing device and method for efficiently distributing slurry. The present invention utilizes ultrasonic energy to facilitate efficient slurry application in a IC wafer fabrication process to permits reduced manufacturing times and slurry consumption during IC wafer fabrication. In one embodiment a chemical mechanical polishing (CMP) ultrasonic transducer slurry dispenser device includes a slurry dispensing slot, a slurry chamber coupled and an ultrasonic transducer. The slurry chamber receives the slurry and transports it to the slurry dispensing slots that apply slurry to a polishing pad. The ultrasonic transducer transmits ultrasonic energy to the slurry. The transmitted ultrasonic energy permits an ultrasonic transducer slurry dispensing device and method of the present invention to achieve a relatively consistent removal rate and a smoother polished wafer surface by facilitating particle disbursement, polishing pad conditioning and uniform slurry distribution.

12 Claims, 15 Drawing Sheets

200D

323

323

800

ULTRASONIC TRANSDUCER SLURRY DISPENSER

FIELD OF THE INVENTION

The field of the present invention pertains to semiconductor fabrication processing. More particularly, the present invention relates to a device for more efficiently utilizing slurry to polish a semiconductor wafer in a chemical mechanical polishing machine.

BACKGROUND OF THE INVENTION

Electronic systems and circuits have made a significant contribution towards the advancement of modern society and are utilized in a number of applications to achieve advantageous results. Numerous electronic technologies such as digital computers, calculators, audio devices, video equipment, and telephone systems include processors that have facilitated increased productivity and reduced costs in analyzing and communicating data, ideas and trends in most areas of business, science, education and entertainment. Frequently, electronic systems designed to provide these results include integrated circuits (ICs) on chip wafers. Usually, the wafers are produced by processes that include a chemical mechanical polishing (CMP) step. Typical CMP processes include the application of a chemical slurry that assists a chemical/mechanical abrasion step that polishes and planarizes the wafer. To be effective and operate properly, most CMP processes require an efficient distribution of the chemical slurry.

The starting material for typical ICs is very high purity silicon. The pure silicon material is grown as a single crystal that takes the shape of a solid cylinder. This crystal is then sawed (like a loaf of bread) to produce wafers upon which electronic components are then constructed by adding multiple layers to the wafer through a process of lithography (e.g., photolithography, X-ray lithography, etc.). Typically, lithography is utilized to form electronic components comprising regions of different electrical characteristics added to the wafer layers. Complex ICs can often have many different built up layers, with each layer being stacked on top of the previous layer and comprising multiple components with a variety of interconnections. The resulting surface topography of these complex IC's are bumpy (often resemble familiar rough terrestrial "mountain ranges" with many rises or "hills" and dips or "valleys") after the IC components are built up in layers.

Lithographic techniques are usually able to reproduce very fine surface geometry and greater advantages and usefulness are realized in applications in which more components (resistors, diodes, transistors, etc.) are integrated into an underlying chip or IC. The primary manner of incorporating more components in a chip is to make each component smaller. In a photolithographic process, limitations on the depth of focus impact the projection of increasingly finer images onto the surface of the photosensitive layer. Depth of focus problems are exacerbated by rough topographies (e.g., the bumpy rises and dips causes by layers produced during lithographic processes). The "bumpy" topography of complex ICs, the "hills" and "valleys," exaggerate the effects of narrowing limits on the depth of focus which in turn limits the number of components that are incorporated on a chip. Thus, in order to focus desirable mask images defining sub-micron geometries onto each of the intermediate photosensitive layers in a manner that achieves the greatest number of components on a single wafer, a precisely flat surface is desired. The precisely flat or fully planarized surface facilitates extremely small depths of focus operations, and in turn, facilitates the definition and subsequent fabrication of extremely small components.

Chemical-mechanical polishing (CMP) is the preferred method of obtaining full planarization of a wafer layer. It usually involves removing a sacrificial portion of material by rubbing a polishing pad covered with a polishing slurry on the surface of the wafer. CMP flattens out height differences on the surface of the wafer, since high areas of topography (hills) are removed faster than areas of low topography (valleys). Most CMP techniques have the rare capability of smoothing out topography over millimeter scale planarization distances leading to maximum angles of much less than one degree after polishing.

As described above, most CMP processes use an abrasive slurry dispensed on a polishing pad to aid in the smooth and predictable planarization of a wafer. The planarizing attributes of the slurry are typically comprised of an abrasive frictional component and a chemical reaction component. The abrasive frictional component is due to abrasive particles suspended in the slurry. The abrasive particles add to the abrasive characteristics of the polishing pad as it exerts frictional contact with the surface of the wafer. The chemical reaction component is attributable to polishing agents which chemically interact with the material of the wafer layer. The polishing agents soften and/or dissolve the surface of the wafer layer to be polished by chemically reacting with it. Together the abrasive frictional component and a chemical reaction component assist a polishing pad to remove material from the surface of the wafer.

The slurry utilized in CMP processes is typically a mixture of de-ionized water, abrasives and polishing agents. The constituents of the slurry are precisely determined and controlled in order to effect optimized CMP planarization. Differing slurries are used for differing layers of the semiconductor wafer, with each slurry having specific removal characteristics for each type of layer. As such, slurries used in extremely precise sub-micron processes (e.g., tungsten damascene planarization) can be very expensive and often represent the most expensive consumable used in the CMP process.

The friction caused by the contact between the rotating polishing pad and the rotating wafer, in conjunction with the abrasive and chemical characteristics of the slurry, combine to remove a top portion of the wafer layer and planarize or polish the wafer at some nominal rate. This rate is referred to as the removal rate. A constant and predictable removal rate is important to the uniformity and performance of the wafer fabrication process. The removal rate should be expedient, yet yield precisely planarized wafers, free from a rough surface topography. If the removal rate is too slow, the number of planarized wafers produced in a given period of time decreases, degrading wafer through-put of the fabrication process. If the removal rate is too fast, the CMP planarization process will not be easy to control and a small variation can impact uniformity and degrade the yield of the fabrication process.

The slurry is usually applied to the polishing pad and transported to the surface of the wafer by the pad. A polishing pad usually has a roughened surface comprising a number of very small pits and gouges that function to efficiently transport slurry to the wafer surface being polished. The efficient transport of slurry produces a fast and consistent removal rate. The polishing pad texture is usually comprised of both the inherently rough surface of the material from which the polishing pad is made and predefined pits and grooves that are manufactured into the surface of the polishing pad. The pits and grooves act as pockets that collect slurry for transportation to and from the wafer. To aid in maintaining the surface quality of a polishing pad, CMP machines typically include a conditioner which is used to roughen the surface of the polishing pad. Without conditioning, the surface of the polishing pad is smoothed during the polishing process and removal rates decrease dramatically. As slurry is "consumed" in the polishing process, the transport of fresh slurry to the surface of the wafer and the removal of polishing by-products away from the surface of the wafer becomes very important in maintaining the removal rate.

The manner in which the slurry is distributed to the polishing pad significantly impacts the effectiveness of the abrasive and chemical characteristics of the slurry in aiding the polishing, which in turn impacts the removal rates. It is important to evenly distribute the slurry over the surface of the pad and wafer so that the removal of the wafer layer is even. If a portion of the wafer is exposed to contact with an excessive amount of slurry it usually is removed at a faster rate and portions that are not exposed to enough slurry is usually removed at a slower rate, creating a rough topography instead of a planarized one. For the same reason, it is also preferable to avoid agglomeration of the slurry particles. Agglomeration of slurry particles is a common problem with typical CMP slurries.

What is required is a system and method that facilitates an efficient application of a slurry in an effective manner to the surface of a polishing pad. The system and method should support an even and disperse distribution of slurry particles while reducing slurry consumption. It should also aid conditioning processes to prepare a pad for continued use.

SUMMARY OF THE INVENTION

The present invention includes an ultrasonic transducer slurry dispensing device and method for efficiently distributing slurry. The present invention utilizes ultrasonic energy to facilitate efficient slurry application in an IC wafer fabrication process to achieve a consistent removal rate and a smoother polished wafer surface. The ultrasonic transducer slurry dispensing device and method of the present invention assists a CMP process to achieve increased wafer planarization by transmitting ultrasonic energy to a slurry. The transmitted ultrasonic energy facilitates particle disbursement, polishing pad conditioning and uniform slurry distribution. The present invention system and method permits reduced manufacturing times and slurry consumption during IC wafer fabrication.

In one embodiment of the present invention, an ultrasonic transducer slurry dispenser transmits ultrasonic energy to a slurry while it dispenses the slurry on a polishing pad. As slurry flows from the ultrasonic transducer slurry dispenser, ultrasonic energy is transferred to the slurry from ultrasonic transducers that are located in close proximity to the polishing pad. The ultrasonic energy exerts ultrasonic forces that cause slurry particles to resist agglomeration and disperse throughout the slurry solution, aids in achieving even dispersement of the slurry solution on the polishing pad and assists polishing pad conditioning efforts by agitating waste particles.

DETAILED DESCRIPTION

Reference will now be made in detail to the preferred embodiments of the invention, an ultrasonic transducer slurry dispensing method and system for efficiently dispensing slurry and conditioning a polishing pad, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be obvious to one ordinarily skilled in the art that the present invention may be practiced without these specific details. In other instances, well known methods, procedures, components, and circuits have not been described in detail as not to unnecessarily obscure aspects of the current invention.

The present invention is a CMP slurry dispensing system and method that utilizes ultrasonic energy to facilitate efficient slurry application in a IC wafer fabrication process. The system and method of the present invention assists a CMP process to achieve increased wafer planarization by facilitating particle disbursement, polishing pad conditioning and uniform slurry distribution. The present invention system and method permits reduced manufacturing times and slurry consumption during IC wafer fabrication.

Figure 1:
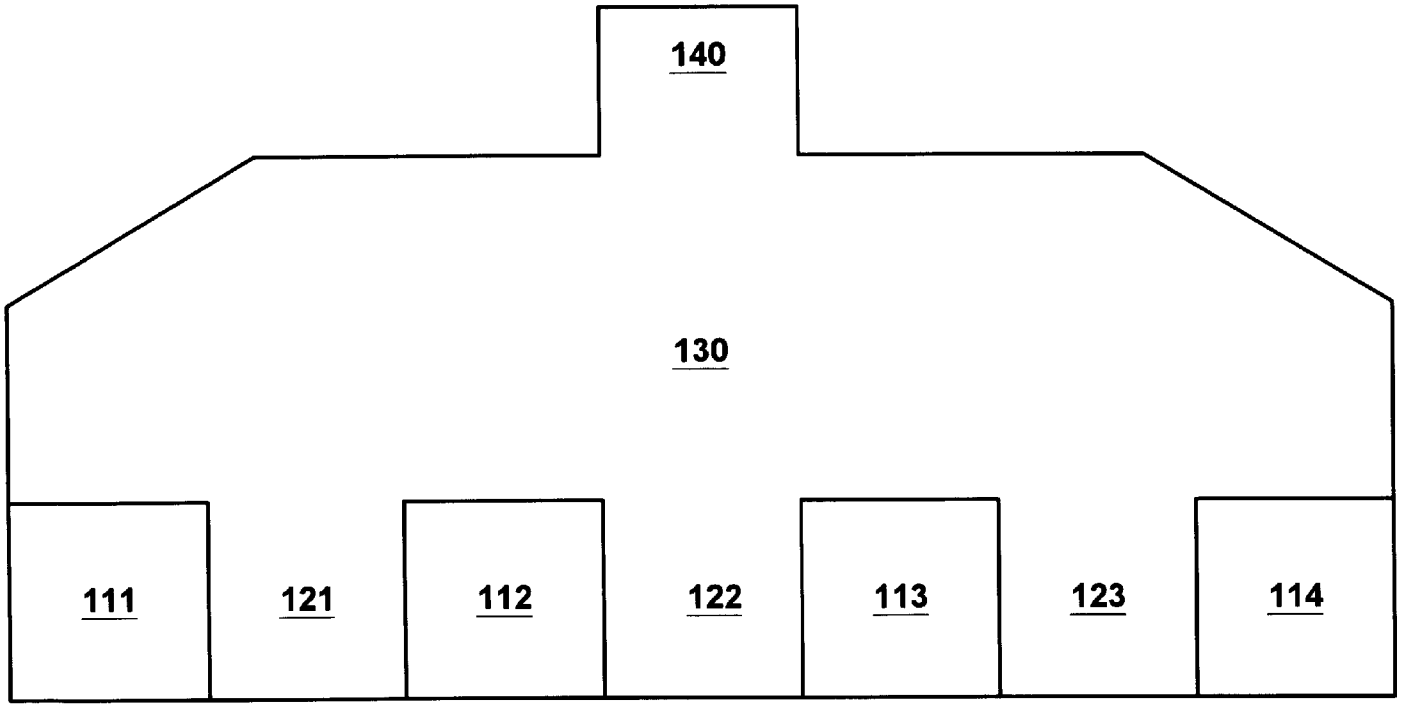
FIG. 1 is a schematic diagram side view of an ultrasonic transducer slurry dispenser of the present invention.

FIG. 1 is a schematic diagram side view of ultrasonic transducer slurry dispenser 100, one embodiment of the present invention. Ultrasonic transducer slurry dispenser 100 comprises ultrasonic transducers 111 through 114, slurry chamber 130 having slurry dispensing slots 121 through 123, and coupler 140. Slurry chamber 130 is coupled to ultrasonic transducers 111 through 114, slurry dispensing slots 121 through 123 and coupler 140. In one embodiment of ultrasonic transducer slurry dispenser 100, ultrasonic transducers 111 through 114 are located intermittently along a side of ultrasonic transducer slurry dispenser 100 that is closest in proximity to a polishing pad (not shown).

The components of ultrasonic transducer slurry dispenser 100 cooperatively function to efficiently disperse a chemical slurry onto a polishing pad. Coupler 140 provides a mechanism to couple ultrasonic transducer slurry dispenser 100 to a slurry reservoir (not shown). In one embodiment of ultrasonic transducer slurry dispenser and pad conditioner 100, coupler 140 is coupled to a slurry tube (not shown) that transports slurry from a slurry reservoir. Slurry chamber 130 receives slurry via coupler 140 and transports it to slurry dispensing slots 121 through 123. Slurry dispensing slots 121 through 123 apply the slurry to the polishing pad. Ultrasonic transducers 111 through 114 transmit ultrasonic energy to the slurry. The ultrasonic energy exerts ultrasonic forces that cause slurry particles to resist agglomeration and disperse throughout the slurry solution, aids even dispersement of the slurry solution on a polishing pad and assists polishing pad conditioning efforts by agitating waste particles.

Figure 2A:
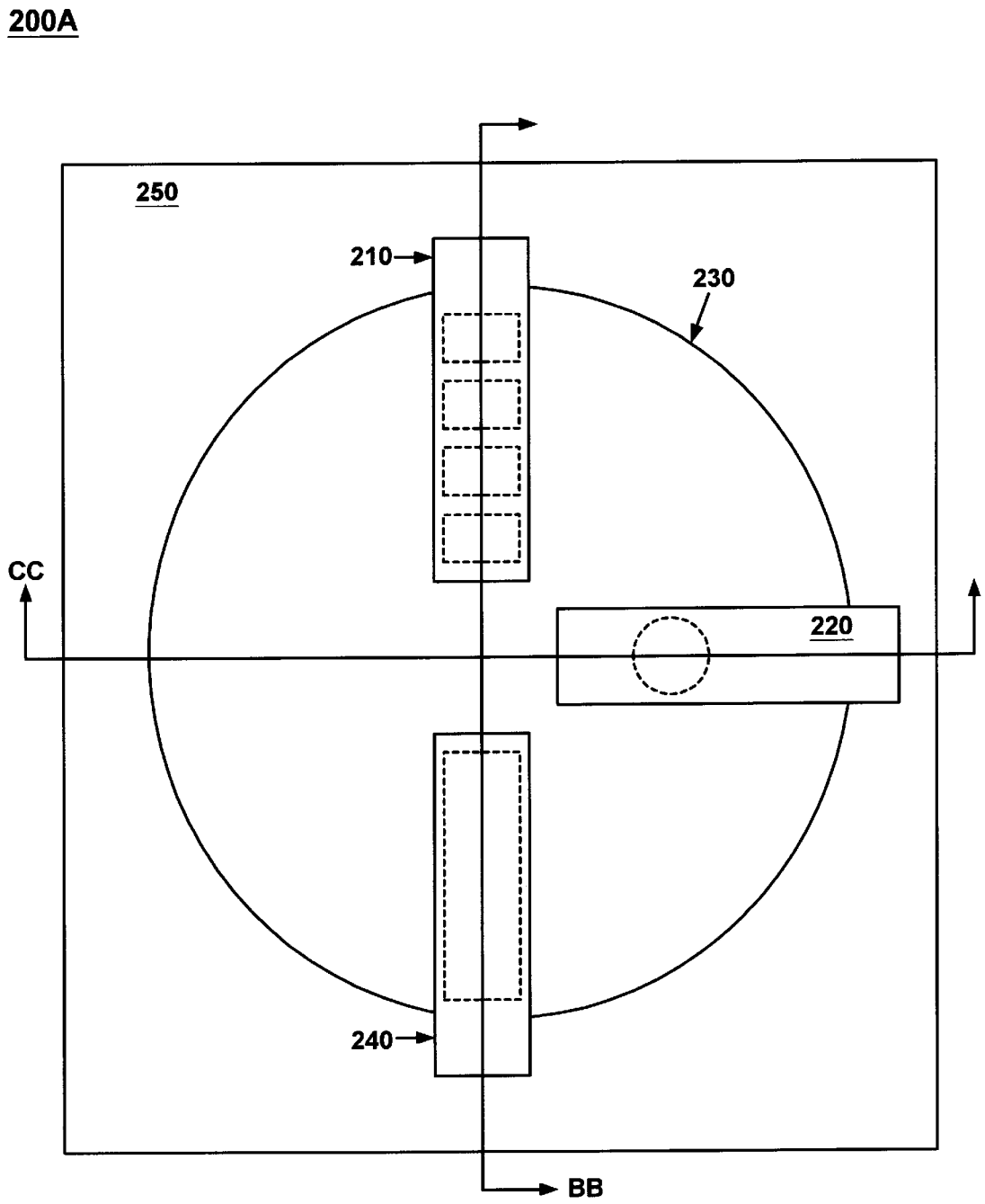
FIG. 2A is a down view of an ultrasonic transducer CMP system in accordance with the present invention.

FIG. 2A is a down view of a CMP system 200A, one embodiment of the present invention. CMP system 200 comprises an ultrasonic transducer slurry dispenser 210, a wafer holder 220, a polishing pad component 230, polishing pad conditioner 240 and CMP machine 250. CMP machine 250 is coupled to ultrasonic transducer slurry dispenser 210, a wafer holder 220, a polishing pad component 230, and polishing pad conditioner 240. The components of CMP system 200 cooperatively operate to planarize an IC wafer. Ultrasonic transducer slurry dispenser 210 transmits ultrasonic energy to a slurry and dispenses it on polishing pad component 230. Wafer holder 220 holds the IC wafer against polishing pad component 230. Polishing pad component 230 polishes and planarizes the IC wafer by applying the slurry and physical frictional force to the surface of the wafer. Polishing pad conditioner 240 conditions the surface of polishing pad component 230.

Figure 2B:
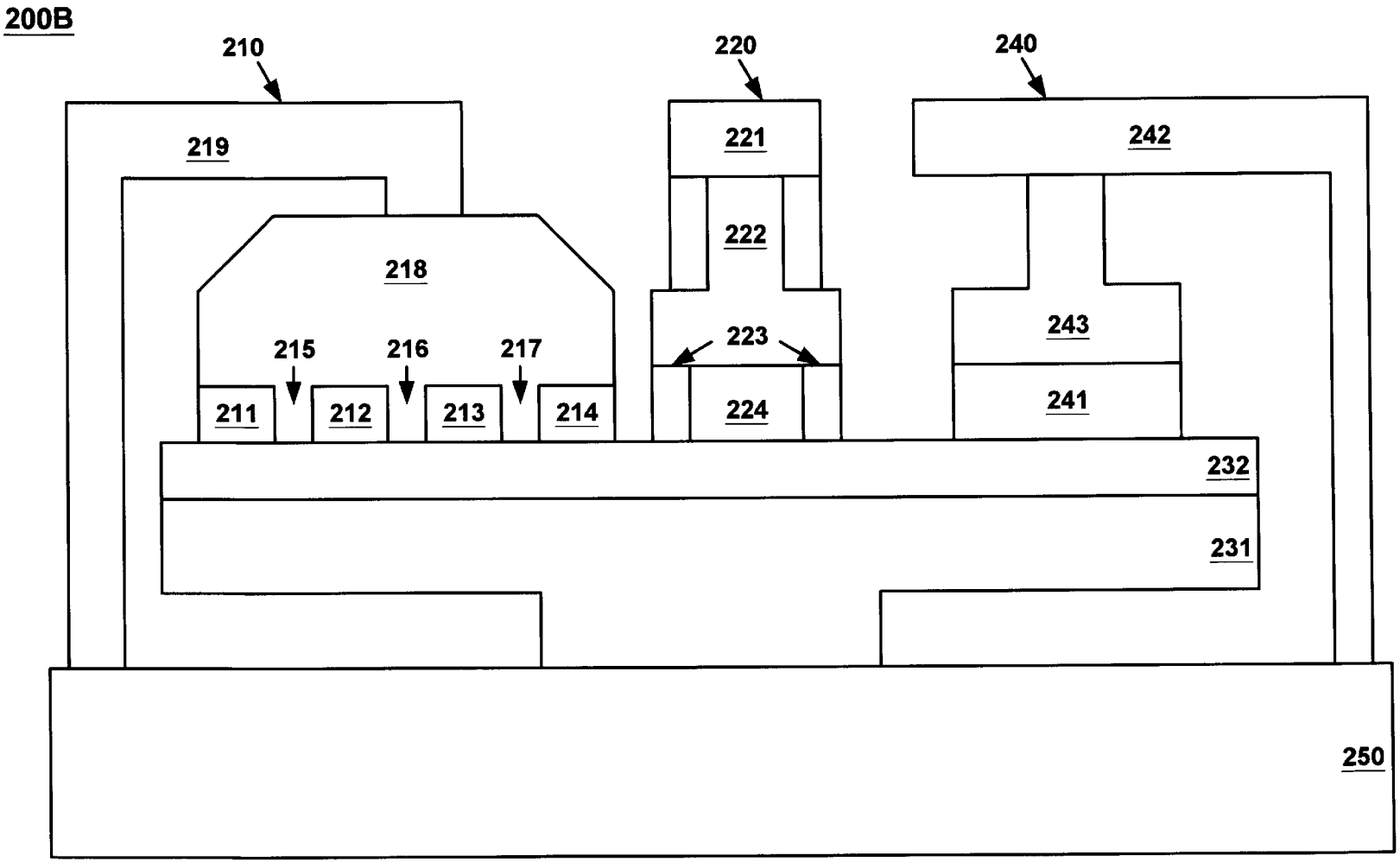
FIG. 2B shows a side view of an ultrasonic transducer CMP system of the present invention.
Figure 2C:
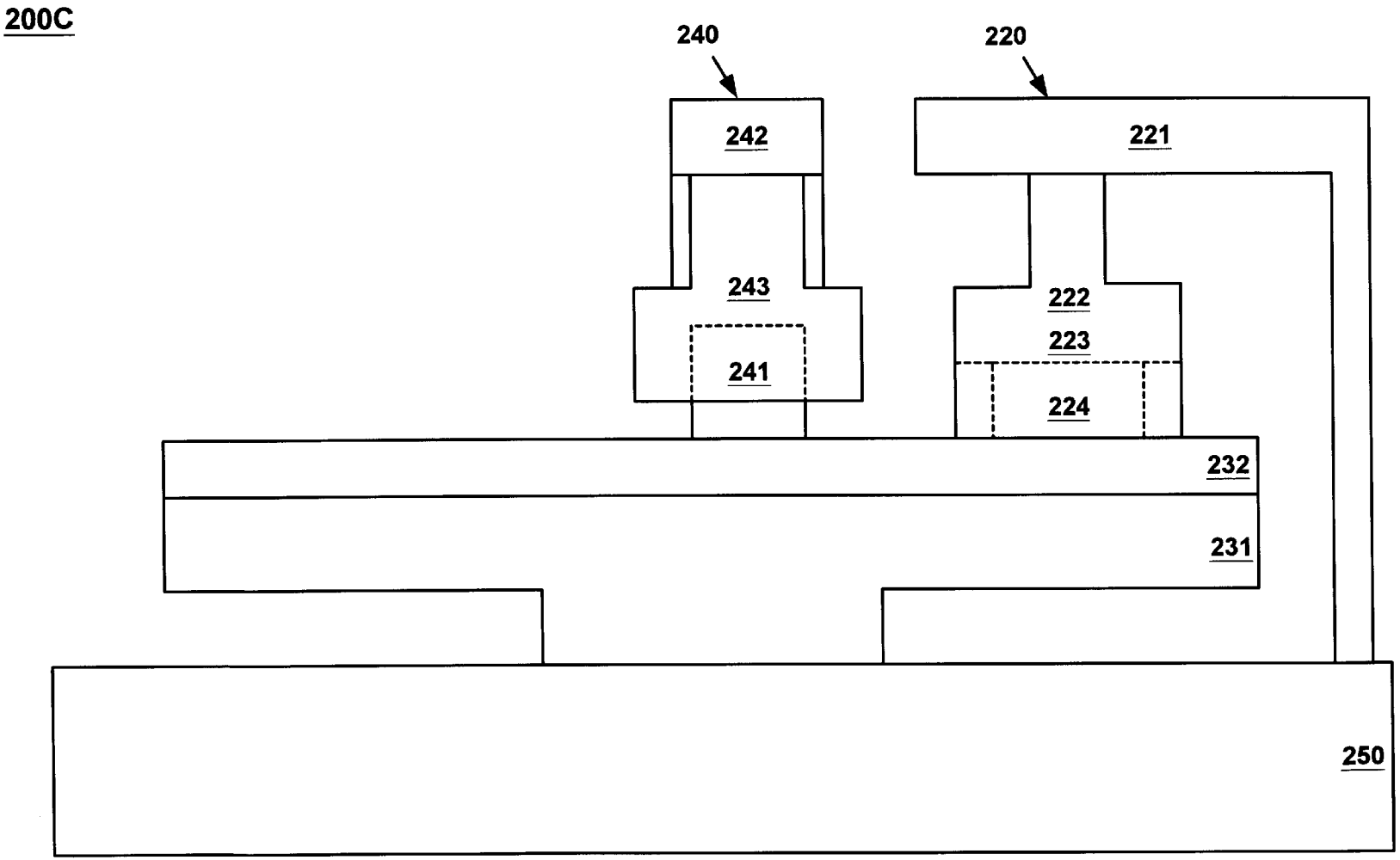
FIG. 2C shows another side view of ultrasonic transducer CMP system of the present invention.

FIG. 2B shows a side view of ultrasonic transducer CMP system 200B, one embodiment of ultrasonic transducer CMP machine 200A. FIG. 2C shows another side view of ultrasonic transducer CMP system 200B. FIG. 2B is a cut away view taken through line BB and FIG. 2C is a cut away view taken through line CC. Ultrasonic transducer CMP system 200B comprises ultrasonic transducer slurry dispenser 210, wafer holder 220, polishing pad component 230, polishing pad conditioner 240 and CMP machine 250. CMP machine 250 is coupled to ultrasonic transducer slurry dispenser 210, wafer holder 220, polishing pad component 230 and polishing pad conditioner 240. The components of ultrasonic transducer CMP system 200B cooperatively function to polish and planarize an integrated circuit (IC) wafer 224.

Figure 2D:
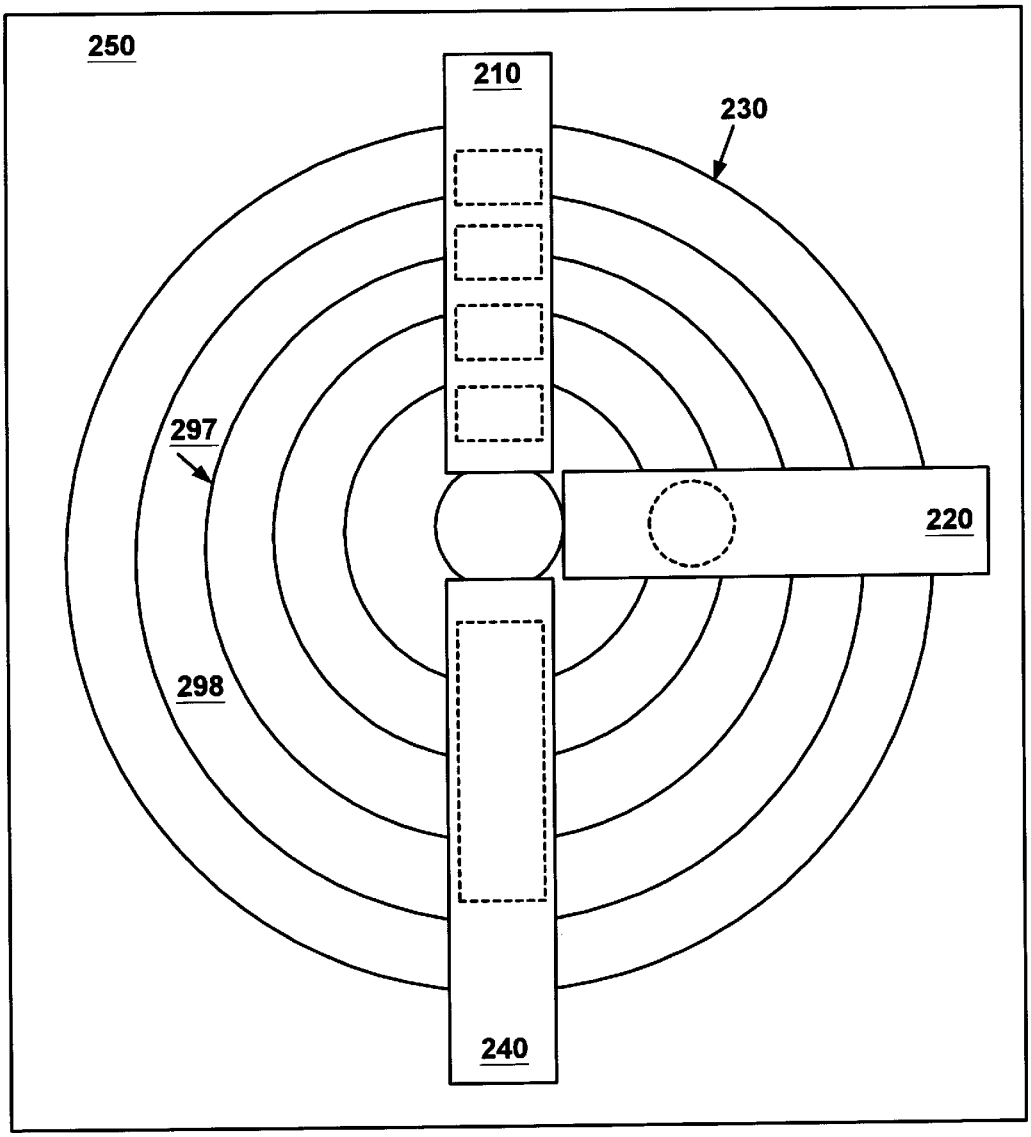
FIG. 2D shows one embodiment of an ultrasonic transducer CMP system in which the polishing pad has circular groves and pits.

Polishing pad component 230 is utilized to transport a slurry to a wafer (e.g., wafer 224) and apply an abrasive frictional force to the surface of the wafer. Polishing pad component 230 comprises a polishing pad 232 and turn table platen 231. Polishing pad 232 is coupled to turn table platen 231. Turn table platen 231 is adapted to rotate polishing pad 232 at a predetermined speed. In one embodiment of the present invention, polishing pad 232 is textured with a plurality of predetermined groves and pits to aid the polishing process by transporting a slurry to the surface of wafer 224. FIG. 2D shows one embodiment of ultrasonic transducer CMP system 200B in which polishing pad 232 has circular groves (e.g., grove 297) and pits (e.g., pit 298).

Ultrasonic transducer slurry dispenser 210 transmits ultrasonic energy to a slurry and dispenses the slurry onto polishing pad 232. Ultrasonic transducer slurry dispenser 210 comprises ultrasonic transducers 211 through 214, slurry chamber 218 having slurry dispensing slots 215 through 217, and coupler arm 219. Slurry chamber 218 is coupled to ultrasonic transducers 211 through 214, slurry dispensing slots 215 through 217 and coupler arm 219. In one embodiment of ultrasonic transducer slurry dispenser 210, ultrasonic transducers 211 through 214 are located intermittently along a side of ultrasonic transducer slurry dispenser 210 that is closest in proximity to polishing pad 232.

The components of ultrasonic transducer slurry dispenser 210 cooperatively function to efficiently disperse a chemical slurry flow onto a polishing pad. Coupler Arm 219 provides a mechanism to couple ultrasonic transducer slurry dispenser 210 to a slurry reservoir (not shown). In one embodiment of ultrasonic transducer slurry dispenser 210, coupler arm 219 is adapted to transport slurry from a slurry reservoir. Slurry chamber 218 receives slurry via coupler arm 219 and transports it to slurry dispensing slots 215 through 217. Slurry dispensing slots 215 through 217 release a flow of the slurry onto polishing pad 232. Ultrasonic transducers 211 through 214 transmit ultrasonic energy to the slurry. The ultrasonic energy exerts ultrasonic forces that cause slurry particles to resist agglomeration and disperse throughout the slurry solution, aids even dispersement of the slurry solution on a polishing and assists polishing pad conditioning efforts by agitating waste particles.

Wafer holder 220 picks up a wafer (e.g., wafer 224) and holds it in place on the polishing pad 232. Wafer holder 220 comprises a holder arm 221, a carrier 222 and a carrier ring 223. Holder arm 221 is coupled to CMP machine 250 and carrier 222 which is coupled to carrier ring 223. The lower surface of the wafer 224 rests against the polishing pad 232. The upper surface of the wafer 224 is held against the lower surface of the carrier 222. As the polishing pad 232 rotates, carrier 222 also rotates wafer 224 at a predetermined rate while forcing the wafer onto the polishing pad 232 with a predetermined amount of down force. The abrasion resulting from the frictional force caused by the rotating action of both the polishing pad 232 and the wafer 224 (with assistance from the slurry) combine to polish and planarize wafer 224.

Polishing pad conditioner 240 aids in maintaining abrasive characteristics of polishing pad 232. Polishing pad conditioner 240 comprises a conditioner arm 240, which extends across the radius of the polishing pad 232, and an end effector 241. Conditioner arm 240 is coupled to end effector 241 and CMP 250. End effector 241 includes a conditioning disk 243 which is used to roughen the surface of the polishing pad 232. The conditioning disk 243 is rotated by the conditioner arm 242 and is translationally moved towards the center of the polishing pad and away from the center of the polishing pad 232, such that the conditioning disk 241 covers the radius of the polishing pad 232, thereby covering nearly the entire surface area of the polishing pad 232 as the polishing pad 232 rotates. End effector 243 facilitates removal of worn out surface of polishing pad 232 and reconstruction of groves and pits in the surface of polishing pad 232. A polishing pad with a continuously roughened surface produces a more constant and often relatively faster removal rate than a non maintained polishing pad.

Figure 2E:
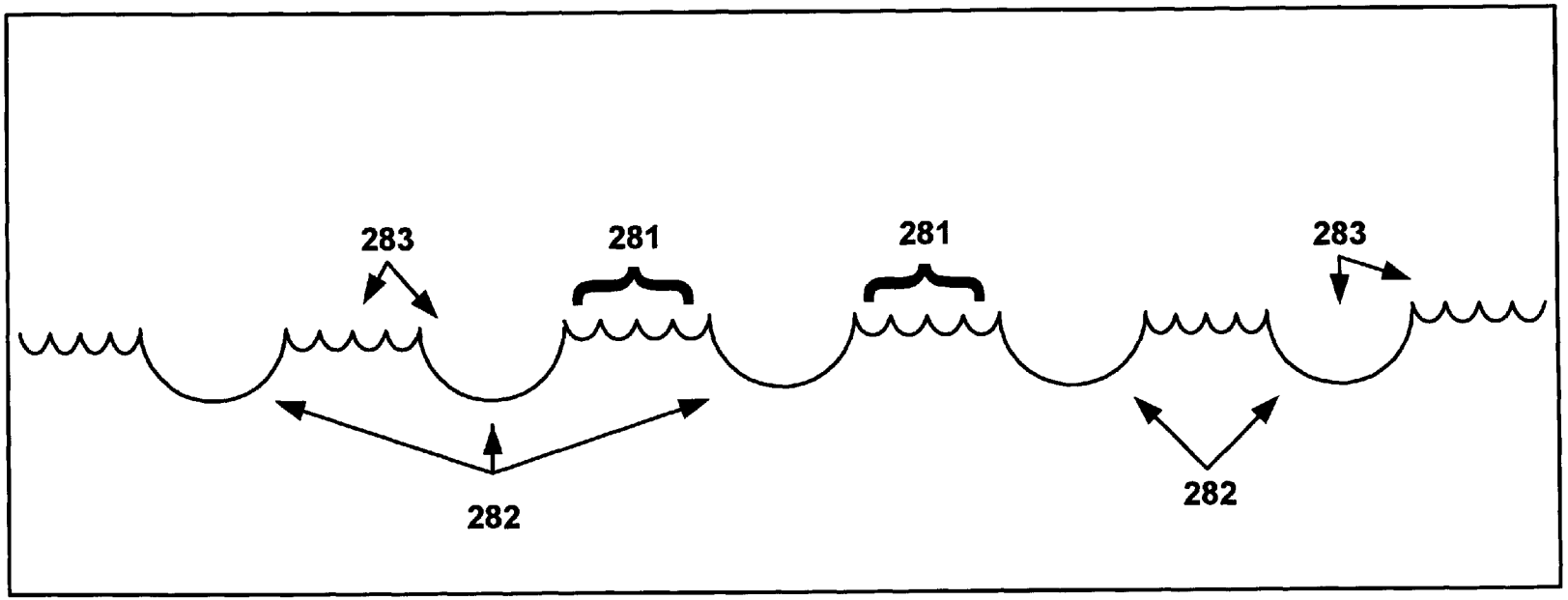
FIG. 2E is a schematic of a polishing pad surface in which various particles have deposited in pits and groves in the polishing pad.
Figure 2F:
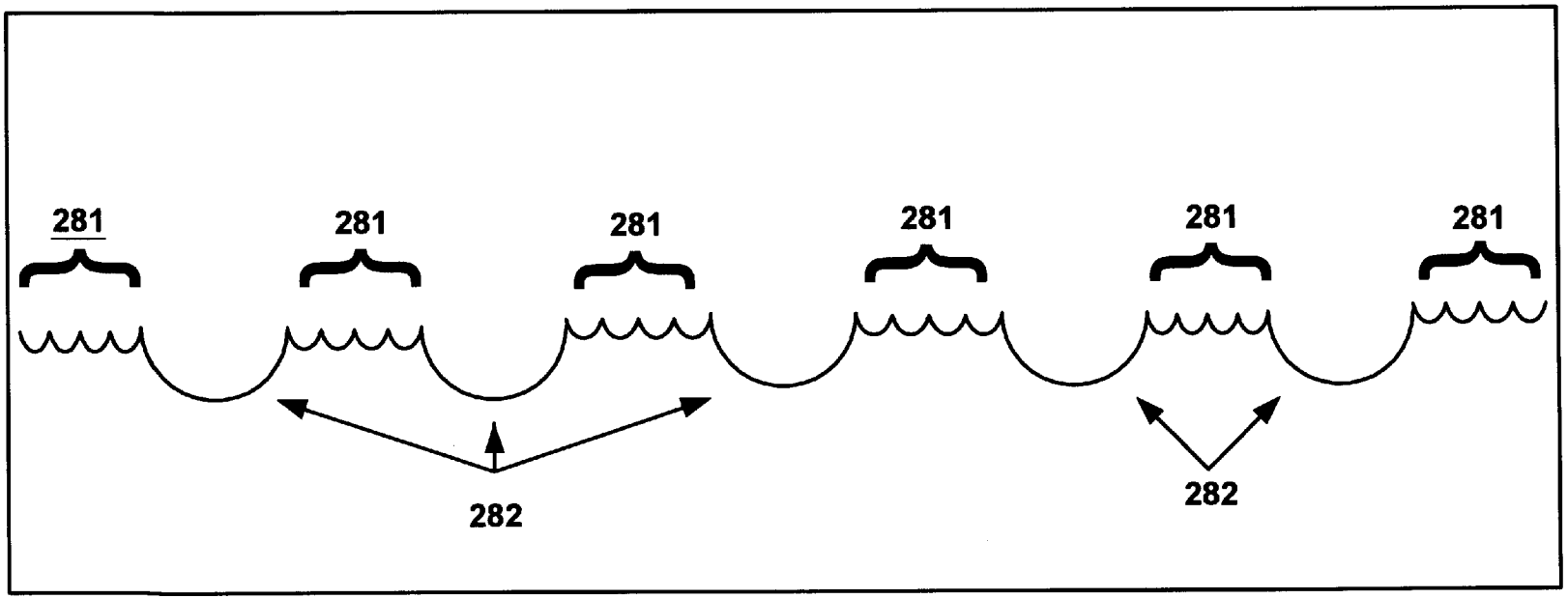
FIG. 2F is a schematic of a polishing pad surface after ultrasonic energy has forced various particles out of pits and groves in a polishing pad.

FIG. 2E is a schematic of one example of a polishing pad surface in which various particles 283 have deposited in pits 281 and groves 282. Without conditioning, the surface of a polishing pad becomes smoother during the polishing process and the removal rate in some examples decreases dramatically. The ultrasonic energy transmitted by ultrasonic transducer slurry dispenser 218 aids in the conditioning process. The ultrasonic energy aids in keeping various particles (e.g., spent slurry particles, waste wafer particles removed by the polishing, etc.) that accumulate on the surface of the polishing pad from clogging up the groves and pits in the surface of the polishing pad. FIG. 2F is a schematic of a polishing pad surface after ultrasonic energy has forced various particles 283 out of pits 281 and groves 282. In one embodiment of the present invention, the transmitted ultrasonic energy forces clear sufficient waste particles out of pits and grooves in the surface of a polishing pad that a separate conditioner (e.g. conditioner component 240) is not required to clean and condition the polishing pad.

CMP machine 250 operates as the primary interface and motor mechanism of ultrasonic transducer CMP system 200B. In one embodiment of the present invention CMP machine 250 includes a motor that rotates polishing pad component 230. In one example of ultrasonic transducer CMP system 200B, CMP machine 250 includes a computer system that controls CMP operations, such as the flow rate of slurry, the downward force and rotational rate of carrier 222, the upward force and rotational rate of polishing pad component 230.

The present invention is capable of dispensing numerous different slurries. In one embodiment of the present invention, the slurry is a mixture of de-ionized water and polishing agents designed to chemically aid the smooth and predictable planarization of the wafer. One example of the present invention includes a slurry in which the abrasion results from chemically active particles such as ceria ($CeO_2$). In these slurries the abrasive particle itself chemically reacts with the dielectric film being removed during polishing. CMP processes utilizing ceria slurries are very tricky, as the waste particles gather on the pad the removal rate actually gets faster and out of control at an exponential rate. The ultrasonic energy transmitted by the present invention is particularly beneficial in keeping ceria slurry particles suspended and easily cleaned from the pad, thus facilitating maintenance of a constant removal rate.

Figure 3A:
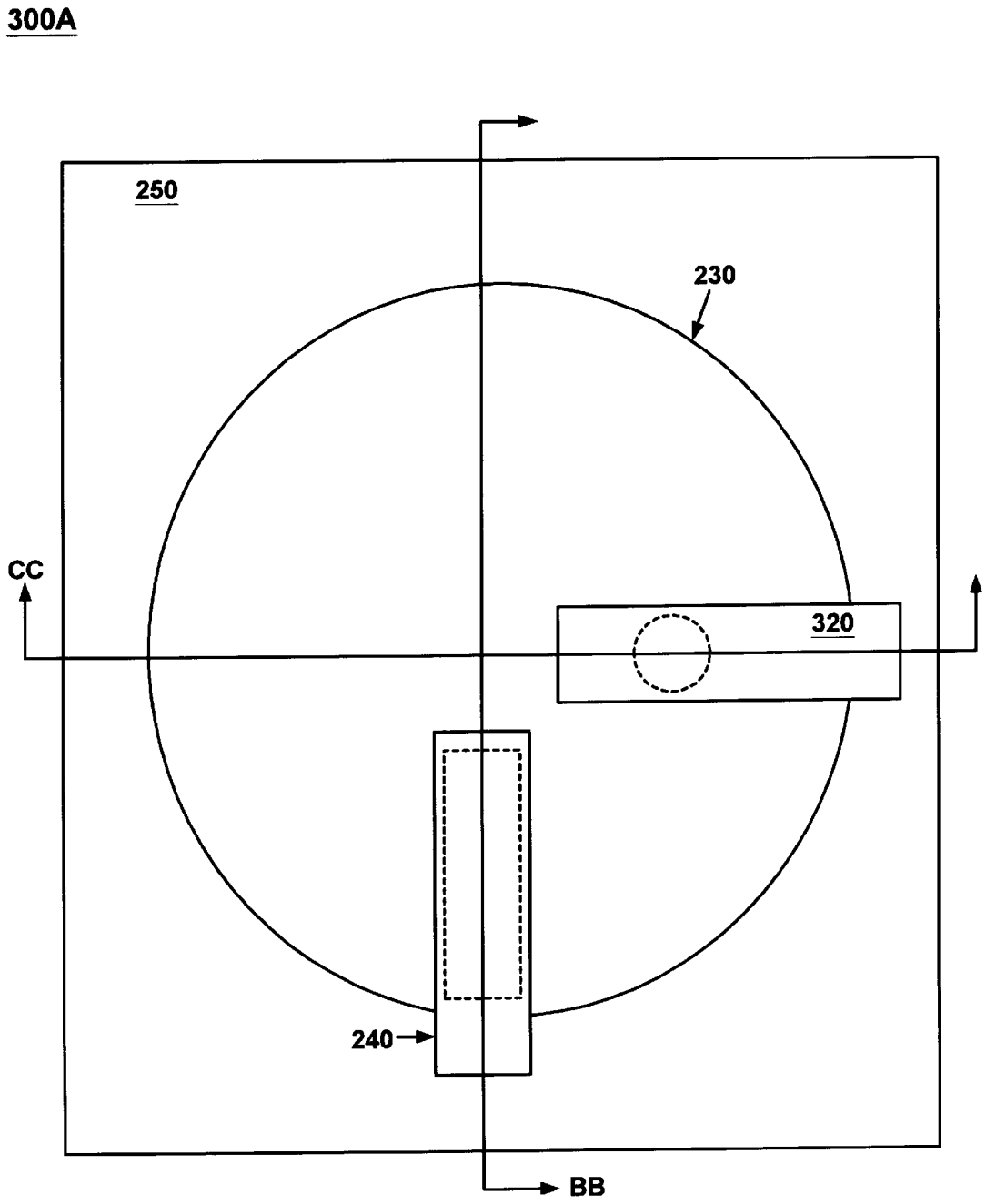
FIG. 3A shows a down view of an ultrasonic transducer slurry dispenser CMP system in accordance with the present invention.
Figure 3B:
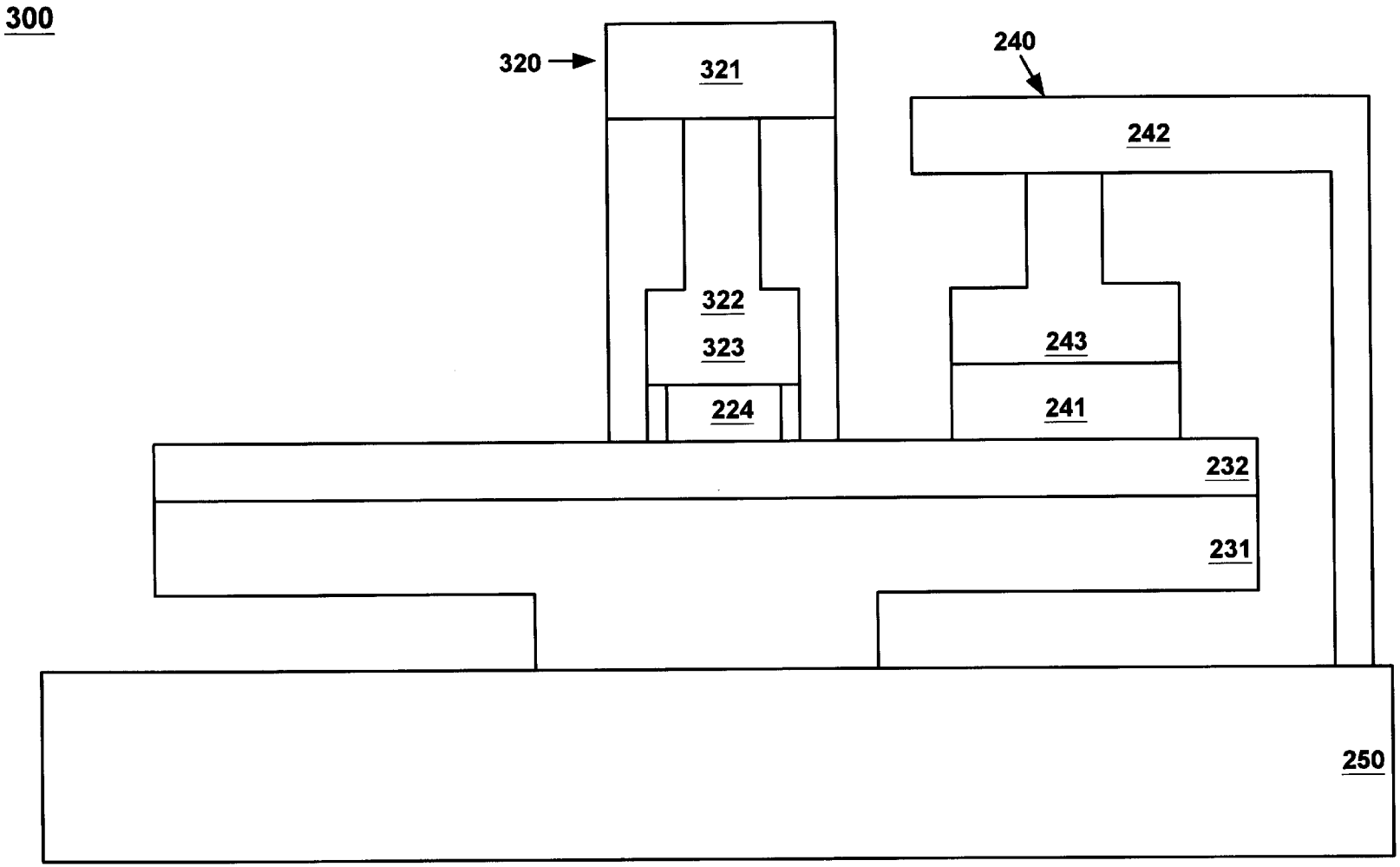
FIG. 3B shows a side view of an ultrasonic transducer slurry dispenser CMP system 300, in accordance with the present invention.

FIG. 3A shows a down view of an ultrasonic transducer slurry dispenser CMP system 300 and FIG. 3B shows a side view of an ultrasonic transducer slurry dispenser CMP system 300, in accordance with the present invention. Ultrasonic transducer slurry dispenser CMP system 300 is similar to ultrasonic transducer CMP system 200A except an ultrasonic slurry distribution system is incorporated in the wafer ring. In one embodiment of the present invention, ultrasonic transducer slurry dispenser CMP system 300 comprises ultrasonic transducer slurry dispenser wafer holder 320, polishing pad component 230, polishing pad conditioner 240 and CMP machine 250. CMP machine 250 is coupled to ultrasonic transducer slurry dispenser wafer holder 320, polishing pad component 230 and polishing pad conditioner 240. The components of ultrasonic transducer CMP system 300 cooperatively function to polish and planarize an integrated wafer 224 in a manner similar to ultrasonic transducer CMP system 200A, except both wafer holding and slurry dispensing functions are performed by ultrasonic transducer slurry dispenser wafer holder 320.

Ultrasonic transducer slurry dispenser wafer holder 320 picks up a wafer (e.g., wafer 224), holds it in place on the polishing pad 232, dispenses a slurry flow onto polishing pad 232, and transmits ultrasonic energy to the slurry. Ultrasonic transducer slurry dispenser wafer holder 320 comprises a holder arm 321, a carrier 322 and an ultrasonic transducer slurry dispensing carrier ring 323 having slurry dispensing slots. Holder arm 321 is coupled to CMP machine 250 and carrier 322 which is coupled to ultrasonic transducer slurry dispensing carrier ring 223. Holder arm 321 is adapted to rotate to pick up a wafer. The lower surface of the wafer 224 rests against the polishing pad 232. The upper surface of the wafer 224 is held against the lower surface of the carrier 322. As the polishing pad 232 rotates, carrier 322 also rotates wafer 224 at a predetermined rate while forcing the wafer 224 onto the polishing pad 232 with a predetermined amount of down force. The abrasion resulting from the frictional force caused by the rotating action of both the polishing pad 232 and the wafer 224 (with assistance from the slurry) combine to polish and planarize wafer 224. The slurry is dispensed from ultrasonic transducer slurry dispensing carrier ring 323.

In accordance with the present invention, ultrasonic transducer slurry dispenser CMP system 300 utilizes ultrasonic transducer slurry dispensing carrier ring 323 for confining wafer 224 on polishing pad 232 to a rotational movement while dispensing slurry onto the polishing pad and transmitting ultrasonic energy. The slurry dispensed by ultrasonic transducer slurry dispensing carrier ring 323 is efficiently utilized. It is "targeted" directly onto wafer 224 which eliminates the need for coating the entire surface of polishing pad 232 with slurry. The slurry is almost immediately in contact with wafer 224 and an ultrasonic force is applied to the slurry to facilitate even distribution on polishing pad 232. These efficient attributes of ultrasonic transducer slurry dispenser CMP system 300 reduce the waste of slurry during CMP processes and renders the CMP processes more cost effective. As slurry is dispensed, it is evenly distributed over the rough surface texture of polishing pad 232 with minimal agglomeration and is transported under the surface of the wafer 224 as both the polishing pad 232 and the wafer 224 rotate. In addition, consumed slurry and polishing by-products that stick to the groves and pits in the surface of the polishing pad 232 while traveling past wafer 224 are resuspended in the "waste" solution for easy removal. Thus ultrasonic energy is applied to waste particles as they are transported away from the surface of ultrasonic transducer slurry dispensing carrier ring 224.

FIG. 4A shows a down view of one embodiment of ultrasonic transducer slurry dispensing carrier ring 323. Ultrasonic transducer slurry dispensing carrier ring 323 comprises carrier ring body 450 having slurry dispensing slots 410 through 417, ultrasonic transducers 420 through 427 and carrier ring interior surface 470. Carrier ring body 450 is coupled to slurry dispensing slots 410 through 417, ultrasonic transducers 420 through 427 and carrier ring interior surface 470. Slurry is fed down from carrier 322 to ultrasonic transducer slurry dispensing carrier ring 323 which distributes the slurry through slurry dispensing slots 410 through 417. Ultrasonic transducers 420 through 427 transmit ultrasonic energy to the slurry.

Figure 4:
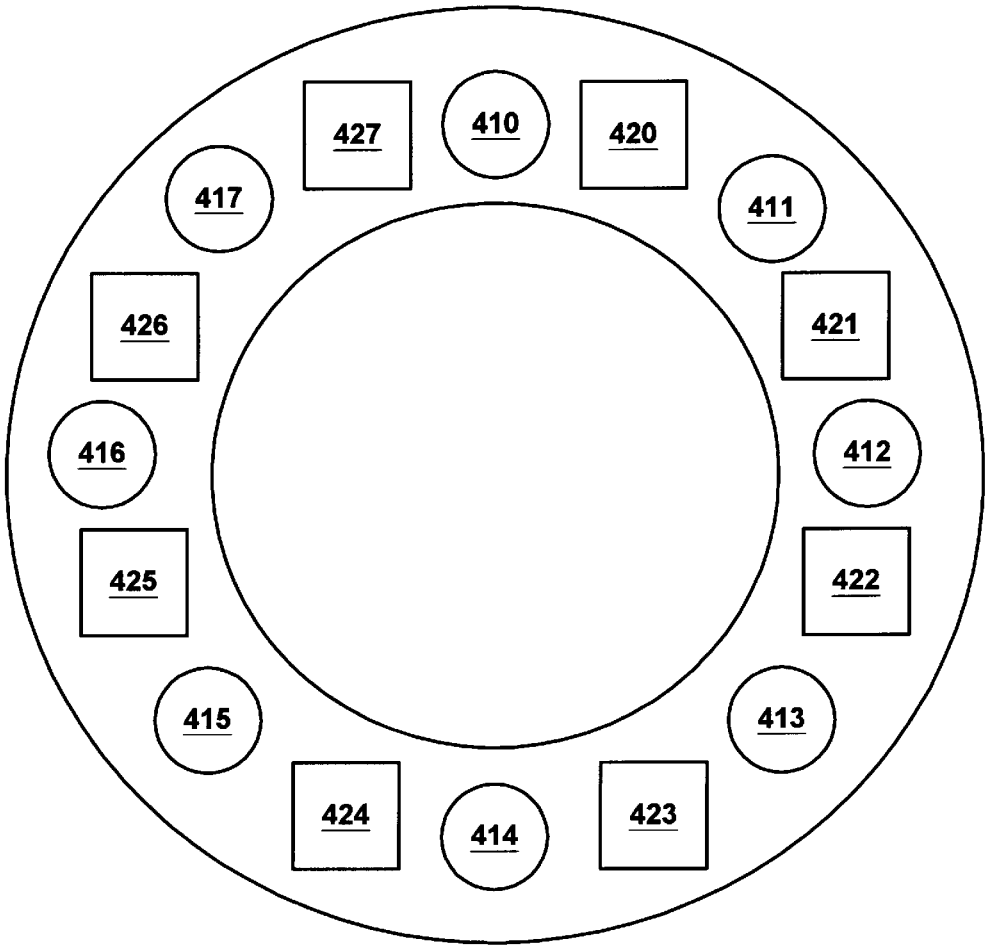
FIG. 4 shows a down view of one embodiment of an ultrasonic transducer slurry dispensing carrier ring.

As depicted in FIG. 4, ultrasonic transducer slurry dispensing carrier ring 323 of the present embodiment has a carrier ring body with a diameter 403 and a lower surface 406 substantially parallel to the plane defined by the diameter 403 and an inner radius surface 402 substantially orthogonal to the plane defined by the diameter 403. The inner radius surface 402 is adapted to confine the semiconductor wafer (e.g., wafer 224). An outer radius surface 401 is located opposite the inner radius surface 402. An upper surface 405 is located opposite the lower surface 406. In the present embodiment, a plurality of slurry dispense slots 410 through 417 extend through the ultrasonic transducer slurry dispensing carrier ring 323 from the upper surface 405 to the lower surface 406, wherein the slurry dispense slots are adapted to permit slurry to flow from the CMP system 300 to the lower surface 406 so that the slurry contacts the wafer 224 confined within the inner radius surface 402.

Figure 5A:
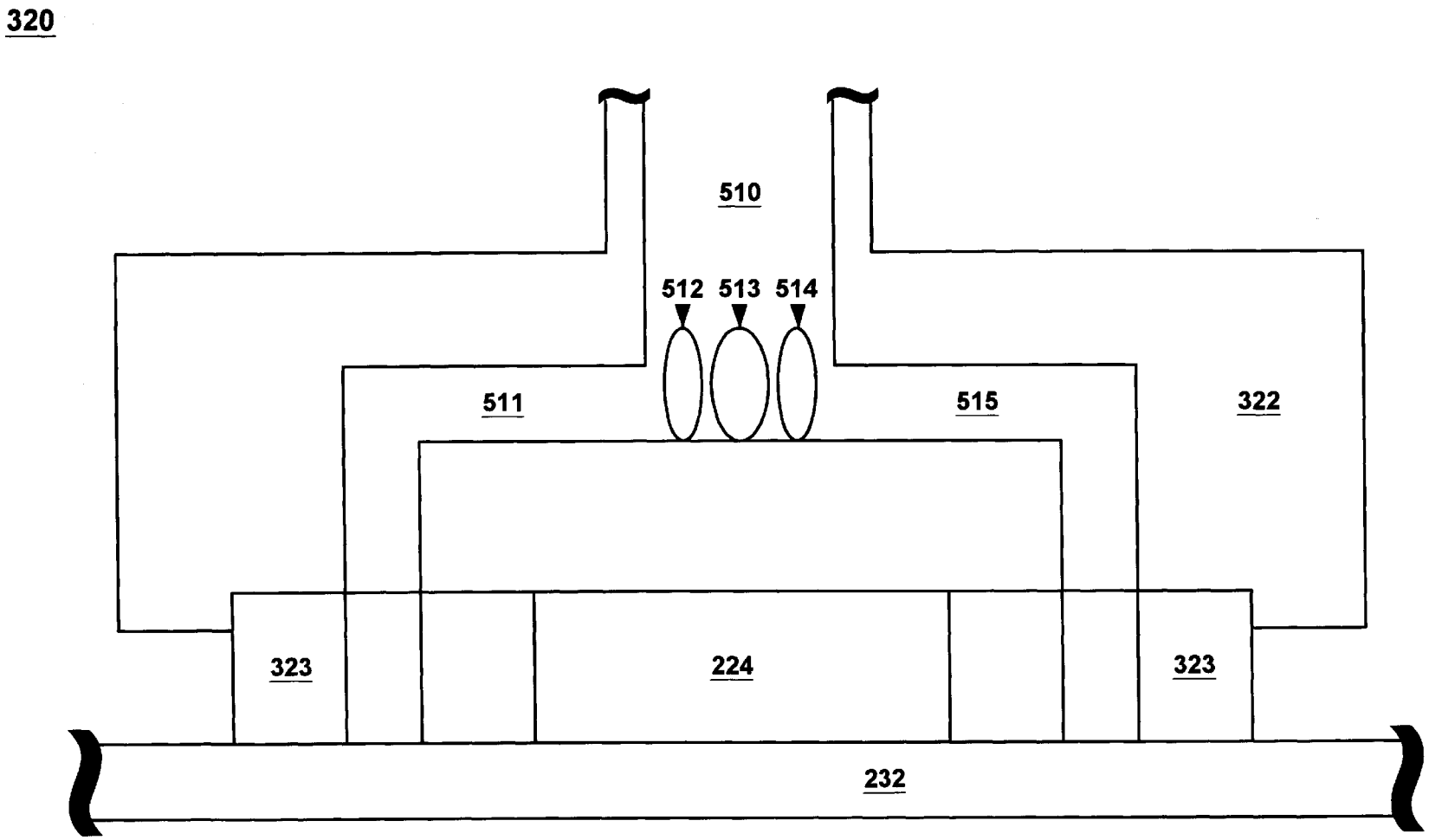
FIG. 5A shows a cut away view through ultrasonic transducers of one embodiment of ultrasonic transducer slurry dispenser wafer holder as it positions a wafer on top of a pad polishing pad.
Figure 5B:
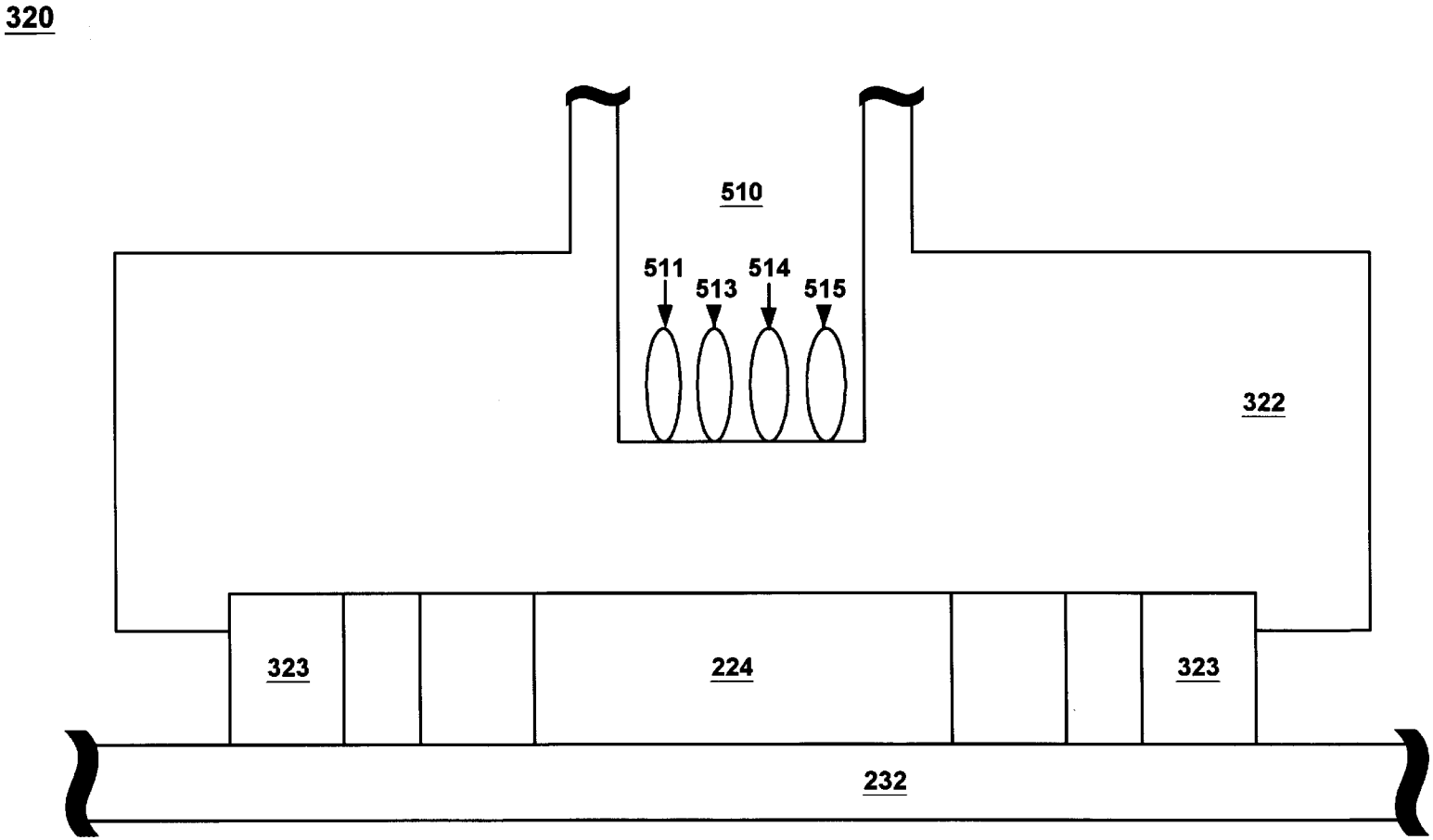
FIG. 5B shows a cut away view through the slurry dispensing slots of one embodiment of an ultrasonic transducer slurry dispenser wafer holder as it positions a wafer on top of pad polishing pad.

FIG. 5A shows a cut away view through ultrasonic transducers of one embodiment of ultrasonic transducer slurry dispenser wafer holder 320 as it positions wafer 224 on top of pad polishing pad 232. FIG. 5B shows a cut away view through the slurry dispensing slots of one embodiment of ultrasonic transducer slurry dispenser wafer holder 320 as it positions wafer 224 on top of pad polishing pad 232. Ultrasonic transducer slurry dispensing carrier ring 323 receives a downward force from carrier 322 and is pressed into the surface of pad polishing pad 232. Wafer 224 is confined in place on pad polishing pad 232 by inner radius surface 402. In one embodiment of the present invention, pad polishing pad 232 includes a slurry conduit 510 that branches off at various points into slurry channels (e.g., slurry channels 511 through 515) to align with each of the slurry dispense slots 410 through 417. CMP system 300 pumps slurry though the slurry conduit 510 and out the slurry dispense slots 410 through 417 and onto pad polishing pad 232.

Figure 6:
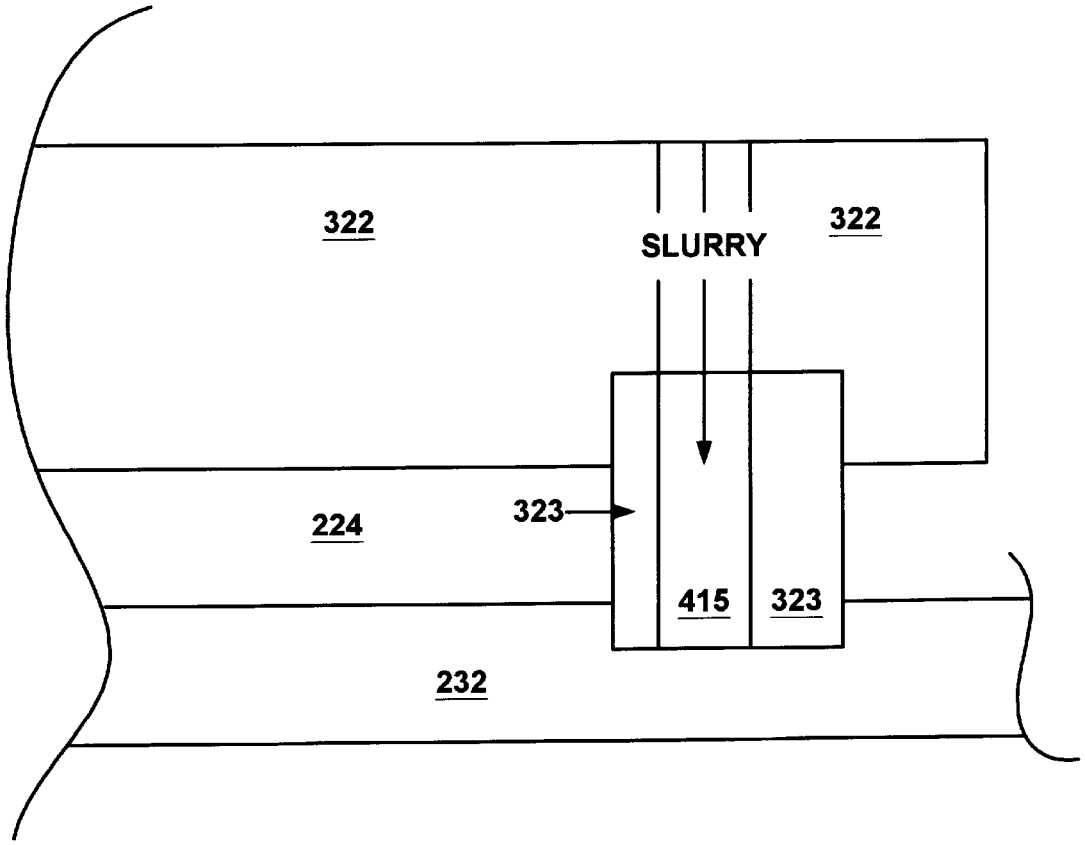
FIG. 6 depicts the an embodiment of the present invention in which the carrier ring protrudes further into the surface of a polishing pad with respect to the surface of a wafer.

FIG. 6 depicts one embodiment of the present invention in which the carrier ring protrudes further into the surface of polishing pad 232 with respect to the surface of wafer 224. As shown in FIG. 6, the lower surface of ultrasonic transducer slurry dispensing carrier ring 223 is pressed further into the surface of polishing pad 232 than the lower surface of wafer 224. This increased carrier ring protrusion is used to reduce nonuniformity in situations were the edges of wafer 224 tend to be polished away faster than the center of wafer 224. Many CMP machines use this increased carrier ring protrusion to decrease the relative force exerted by polishing pad 232 against the edges of wafer 224 in comparison to the among force exerted against the center of wafer 224. This counteracts the fact of the edges of wafer 224 having a greater angular velocity (e.g., due to the rotation of wafer 224 by arm carrier 322) on polishing pad 232 than the center of wafer 224. Ultrasonic transducer slurry dispensing carrier ring 323 of the present invention facilitates uniform slurry delivery to wafer 224 without interference by the increased carrier ring protrusion into a polishing pad since the slurry flows from the bottom of the carrier ring and the leading edge of the carrier ring does not impede transportation of slurry to the wafer.

It should be noted that slurry can be pumped through ultrasonic transducer slurry dispensing carrier ring 323 in a symmetric or asymmetric manner. In the case where slurry is pumped through ultrasonic transducer slurry dispensing carrier ring 323 in a symmetric manner, each of the slurry dispensing slots 410 through 417 receive an amount of slurry from slurry conduit 510. In one embodiment of the present invention each of the slurry dispense slots 410 through 417 deliver approximately the same amount of slurry to polishing pad 232. In the case where slurry is pumped through ultrasonic transducer slurry dispensing carrier ring 323 in an asymmetric manner, each of the slurry dispense slots 410 through 417 in a certain region of the ultrasonic transducer slurry dispensing carrier ring 323 receive slurry as the wafer 224 is being polished.

In one embodiment of ultrasonic transducer slurry dispenser CMP system 300 slurry is dispensed from an area of ultrasonic transducer slurry dispensing carrier ring 323 that comprises the leading edge as polishing pad 232 passes by it. For example, as polishing pad 232 rotates beneath wafer 224, slurry can be pumped to which ever of the slurry dispense slots 410 through 417 are on the "leading-edge" of ultrasonic transducer slurry dispensing carrier ring 323 with respect to polishing pad 232. This provides the advantage of injecting slurry onto the polishing pad in an area closest to the leading-edge of wafer 224. As the polishing pad and wafer continue their rotation the slurry subsequently contacts the full surface of wafer 224 with even less waste.

Figure 7:
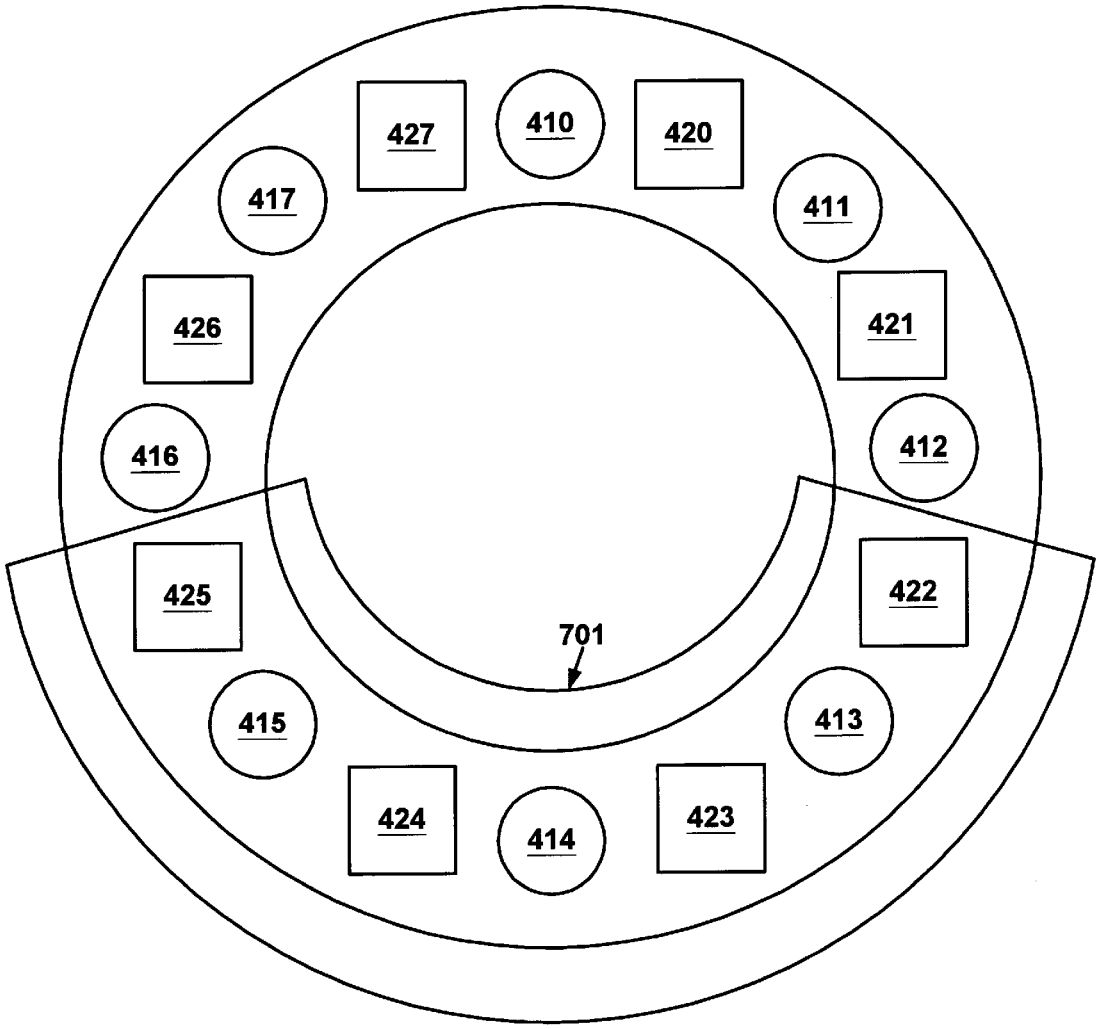
FIG. 7 shows one embodiment of the present invention in which slurry is dispensed through the slurry dispensing slots in a region closest to the leading edge of the wafer trajectory with respect to a polishing pad.

FIG. 7 shows one embodiment of the present invention in which slurry is dispensed through the slurry dispensing slots in region 701, which is a region closest to the leading edge of the wafer trajectory with respect to polishing pad 232. It should be noted that ultrasonic transducer slurry dispensing carrier ring 323 rotates as it slides across the surface of polishing pad 232. Accordingly, new slurry dispense slots are constantly being rotated into dispensing region 701 (wherein region 701 remains fixed on the leading-edge of ultrasonic transducer slurry dispensing carrier ring 323) and slurry dispense holes slots 410 through 417 are constantly being rotated out of dispensing region 701.

Leading-edge slurry injection provides the advantage of ensuring slurry is not injected underneath the trailing edge of ultrasonic transducer slurry dispensing carrier ring 323 and thus wasted. When slurry injected underneath the trailing edge of ultrasonic transducer slurry dispensing carrier ring 323 rapidly flows away from wafer 224 it is not as efficiently utilized as slurry injected underneath the leading-edge ultrasonic transducer slurry dispensing carrier ring 323. The ultrasonic transducers 420 through 427 continue to transmit ultrasonic energy as ultrasonic transducer slurry dispensing carrier ring 323 rotates. Thus, abrasive slurry particles are evenly distributed across the leading edge as slurry is applied and waste particles are agitated as they leave the trailing edge.

In addition to minimizing waste, it should be appreciated that the ultrasonic transducer slurry dispensing carrier ring 323 of the present invention greatly reduces the amount of atmospheric exposure to which the slurry is subjected. Some slurries used in the CMP process tend to react with oxygen in the air. Many slurries also tend to be very sensitive to temperature variations. By precisely targeting the delivery of slurry to the surface of wafer 224 exposure to the atmosphere is limited and the temperature of slurry can be much more tightly controlled. This mitigates the need for exotic gas pressurized (e.g., nitrogen pressurized CMP machine enclosures) CMP machines and the need for expensive temperature regulating equipment. Additionally, some modern CMP processes are migrating to the use of higher polishing pad rotation speeds. The increase polishing pad speeds make the targeted delivery of slurry even more important. For example, in prior art CMP machines, high polishing pad rotation speeds increase the centrifugal force imposed on the slurry, thereby increasing the tendency to "fling" slurry off of the polishing pad before it can be used by wafer 224.

It should be noted that there are several means of implementing a dispensing region within ultrasonic transducer slurry dispensing carrier ring 323. For example, carrier 322 can include a manifold adapted to provide slurry only to those slots 410 through 417 which are in the correct region (e.g. within dispensing region 701). This manifold remains fixed even though ultrasonic transducer slurry dispensing carrier ring 323 and wafer 224 are rotated with respect polishing pad 232.

Figure 8:
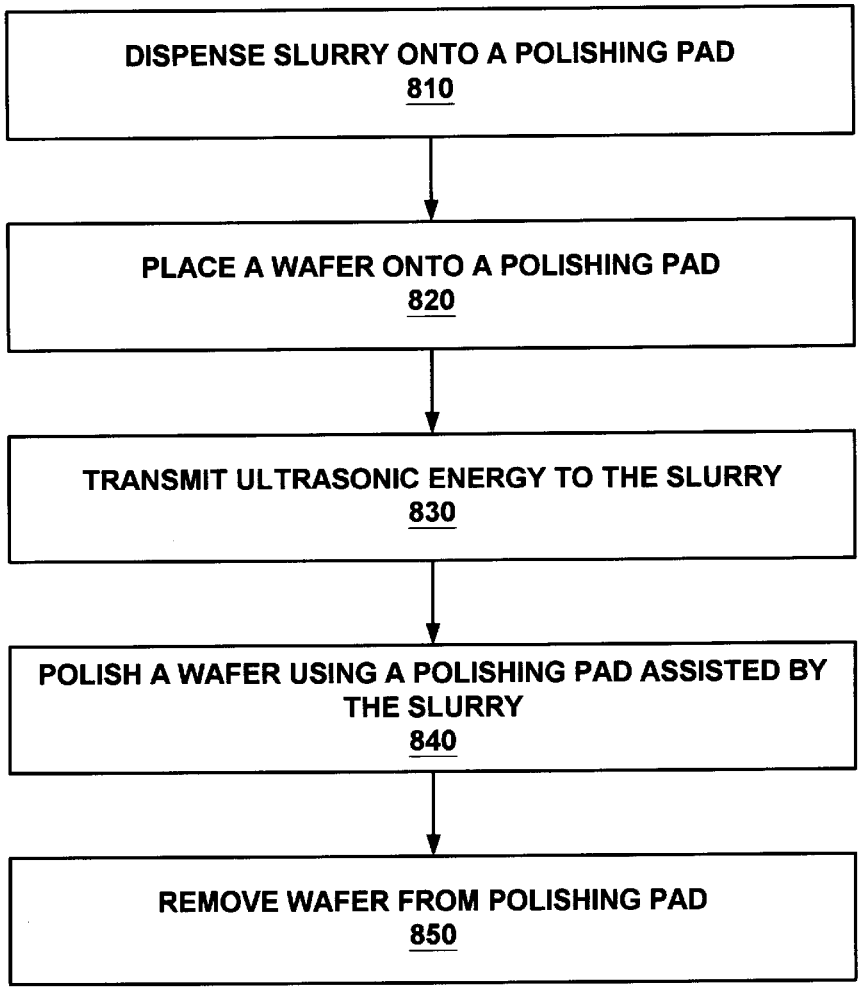
FIG. 8 is a flow chart of the steps of an ultrasonic transducer slurry dispensing CMP method in accordance with one embodiment of the present invention.

FIG. 8 is a flow chart of the steps of an ultrasonic transducer slurry dispensing CMP method 800 in accordance with one embodiment of the present invention. Ultrasonic transducer-slurry dispensing CMP method 800 utilizes ultrasonic energy to facilitate efficient slurry application in a IC wafer fabrication process. The method of the present invention assists a CMP process to achieve increased wafer planarization by facilitating particle disbursement, polishing pad conditioning and uniform slurry distribution. Ultrasonic transducer slurry dispensing CMP method 800 of the present invention permits reduced manufacturing times and slurry consumption during IC wafer fabrication.

In step 810, slurry is dispensed onto a polishing pad (e.g., polishing pad 23) which brings the slurry into contact with a wafer (e.g., wafer 224). In one embodiment, the slurry is poured onto the polishing pad via a slurry dispensing slot (e.g., slurry dispensing slots 121 through 123, or 420 through 427, etc.,). The slurry coats the surface of polishing pad 232 within the diameter of dispensing ring 323 and quickly coats the lower surface of wafer 244.

In step 820 a wafer is placed onto the a polishing pad of a CMP system. In one embodiment of ultrasonic transducer slurry dispensing CMP method 800, wafer 224 is placed onto polishing pad 232 by ultrasonic transducer slurry dispenser wafer holder 220. In another embodiment of ultrasonic transducer slurry dispensing CMP method 800, wafer 224 is placed onto polishing pad 232 by ultrasonic transducer slurry dispenser wafer holder 320.

Ultrasonic energy is transmitted to the slurry in step 830. In one embodiment of the present invention the ultrasonic energy is transmitted by ultrasonic transducers. For example, in one embodiment of ultrasonic transducer slurry dispensing CMP method 800, ultrasonic transducers 111 through 114 transmit ultrasonic energy to the slurry and in another embodiment ultrasonic transducers 420 through 427 transmit ultrasonic energy to the slurry. In another embodiment of the present invention the ultrasonic energy is also applied to the polishing pad.

In step 840, wafer is polished using the polishing pad with assistance from the slurry. In one embodiment of the present invention the polishing includes rubbing a wafer against a surface of polishing pad coated with abrasive slurry. For example, polishing pad component 230 is transports a slurry to a wafer (e.g., wafer 224) and applies an abrasive frictional force to the surface of the wafer. Polishing pad component 230 comprises a polishing pad 232 and turn table platen 231. The polishing pad component rotates at a predetermined speed and is made of a material that is textured with a plurality of predetermined groves and pits to aid the polishing process by transporting a slurry to the surface of wafer. As ultrasonic transducer slurry dispensing CMP method 800 continues, excess material is continually removed from the surface of that wafer, thereby achieving the desired planarity.

In step 850, the wafer is removed from polishing pad when the wafer has been fully planarized. In one embodiment of ultrasonic transducer slurry dispensing CMP method 800, a CMP machine subsequently sends the wafer now in a polished condition forward in the fabrication line for the next step in processing and prepares for a next wafer from a queue.

Thus, the slurry dispensing carrier ring of the present invention provides a device that reduces the waste of slurry in the CMP process of a CMP machine. The present invention provides a device that reduces the amount of wasted slurry without the drawbacks of prior art slurry recycling schemes. In addition, the present invention provides a device that renders the CMP process more cost effective by using slurry in the most efficient manner.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order best to explain the principles of the invention and its practical application, thereby to enable others skilled in the art best to utilize the invention and various embodiments with various modifications as are suited to the particular use contemplated. It is intended that the scope of the invention be defined by the claims appended hereto and their equivalents.

What is claimed is:

1. An ultrasonic slurry dispensing chemical mechanical polishing (CMP) system for planarizing an integrated circuit wafer comprising:

a CMP machine adapted to operate as the primary interface and motor mechanism of said ultrasonic slurry dispensing CMP system;

a polishing pad component coupled to said CMP machine, said polishing pad adapted to polish and planarize an integrated circuit (IC) wafer and to transport said slurry to said wafer and apply an abrasive frictional force to a surface of said wafer;

a wafer holder coupled to said CMP machine, said wafer holder adapted to hold said IC wafer against said polishing pad component; and an ultrasonic transducer slurry dispenser coupled to said CMP, said ultrasonic transducer slurry dispenser adapted to transmit ultrasonic energy to said slurry and dispenses a flow of said slurry on said polishing pad component, said ultrasonic transducer slurry dispenser further comprises a coupler arm coupled to said slurry chamber, said coupler arm adapted to transport slurry from a slurry reservoir.

2. The ultrasonic slurry dispensing chemical mechanical polishing (CMP) system of claim 1 further comprising:

a polishing pad conditioner coupled to said CMP machine, said polishing pad conditioner adapted to condition a surface of said polishing pad component.

3. The ultrasonic slurry dispensing chemical mechanical polishing (CMP) system of claim 2 wherein said ultrasonic energy transmitted by said ultrasonic transducer slurry dispenser aids said polishing pad conditioner by keeping various particles that accumulate on the surface of said polishing pad from clogging up groves and pits in said surface of said polishing pad.

4. The ultrasonic slurry dispensing chemical mechanical polishing (CMP) system of claim 1 in which said ultrasonic energy transmitted to said slurry causes slurry particles to resist agglomeration and disperse throughout a slurry solution, aids even dispersement of said slurry solution on a polishing and assists polishing pad conditioning efforts by agitating waste particles.

5. An ultrasonic slurry dispensing chemical mechanical polishing (CMP) system of claim 1 in which said ultrasonic transducer slurry dispenser dispenses a flow of slurry onto said polishing pad and further comprises:

a slurry chamber having a slurry dispensing slot adapted to apply slurry to a polishing pad, said slurry chamber adapted to receive said slurry and transport it to said slurry dispensing slot; and an ultrasonic transducer coupled to said slurry dispensing slot, said ultrasonic transducer adapted to transmit ultrasonic energy to said slurry.

6. An ultrasonic slurry dispensing chemical mechanical polishing (CMP) system for planarizing integrated circuit wafer comprising:

a CMP machine adapted to operate as the primary interface and motor mechanism of said ultrasonic transducer CMP system;

a polishing pad component coupled to said CMP machine, said polishing pad adapted to polish and planarize an integrated circuit (IC) wafer; and an ultrasonic transducer slurry dispenser wafer holder coupled to said CMP machine, said ultrasonic transducer slurry dispenser wafer holder adapted to hold said wafer in place on said polishing pad component while dispensing a slurry onto said polishing pad component and transmitting ultrasonic energy to said slurry, said ultrasonic transducer slurry dispenser wafer holder includes a holder arm is coupled to said CMP machine, said holder arm adapted to rotate and to pick up a wafer;

a carrier coupled to said holder arm, said carrier adapted to rotate said wafer at a predetermined rate while forcing said wafer onto said polishing pad with a predetermined amount of down force; and an ultrasonic transducer slurry dispensing carrier ring coupled to said carrier, said ultrasonic transducer slurry dispensing carrier ring adapted to confine said wafer on said polishing pad to a rotational movement while dispensing slurry onto said polishing pad and transmitting said ultrasonic energy.

7. An ultrasonic slurry dispensing chemical mechanical polishing (CMP) system of claim 6 further comprising a polishing pad conditioner coupled to said CMP machine, said polishing pad conditioner adapted to condition a surface of said polishing pad component.

8. An ultrasonic slurry dispensing chemical mechanical polishing (CMP) system of claim 6 said ultrasonic energy transmitted by said ultrasonic transducer slurry dispenser wafer holder aids said polishing pad conditioner by keeping various particles that accumulate on the surface of said polishing pad from clogging up groves and pits in said surface of said polishing pad.

9. The ultrasonic slurry dispensing chemical mechanical polishing (CMP) system of claim 6 in which said ultrasonic energy transmitted to said slurry causes slurry particles to resist agglomeration and disperse throughout a slurry solution, aids even dispersement of said slurry solution on a polishing and assists polishing pad conditioning efforts by agitating waste particles.

10. An ultrasonic slurry dispensing chemical mechanical polishing (CMP) system of claim 6 in which said polishing pad component is utilized to transport said slurry to said wafer and apply an abrasive frictional force to a surface of said wafer.

11. An ultrasonic slurry dispensing chemical mechanical polishing (CMP) system claim 6 in which said ultrasonic transducer slurry dispenser carrier ring further comprises:

a carrier ring body with a diameter and a lower surface substantially parallel to the plane defined by said diameter and an inner radius surface substantially orthogonal to the plane defined by said diameter; said carrier ring body having a slurry dispensing adapted to permit slurry to flow to said lower surface so that said slurry contacts said wafer confined within said inner radius surface; and an ultrasonic transducer coupled to said carrier body; said ultrasonic transducer adapted to transmit ultrasonic energy to said slurry.

12. An ultrasonic slurry dispensing chemical mechanical polishing (CMP) system claim 6 in which said ultrasonic transducer slurry dispenser carrier ring dispenses said slurry in an asymmetric manner in which a slurry dispense receives slurry in a certain region of the ultrasonic transducer slurry dispensing carrier ring.

* * * * *